US006536814B2

(12) United States Patent
Kachouh

(10) Patent No.: US 6,536,814 B2
(45) Date of Patent: Mar. 25, 2003

(54) MOTOR VEHICLE DOOR LOCK WITH A CONTROLLED ACTUATING ELEMENT

(75) Inventor: Checrallah Kachouh, Dortmund (DE)

(73) Assignee: Brose Schliessysteme GmbH, Coburg (DE)

( * ) Notice: Subject to any disclaimer, the term of this patent is extended or adjusted under 35 U.S.C. 154(b) by 0 days.

(21) Appl. No.: 09/800,972

(22) Filed: Mar. 8, 2001

(65) Prior Publication Data

US 2001/0048227 A1 Dec. 6, 2001

(30) Foreign Application Priority Data

Mar. 8, 2000 (DE) ..... 200 10 664 U
Jun. 15, 2000 (DE) ..... 100 28 797
Aug. 28, 2000 (DE) ..... 100 42 191

(51) Int. Cl.[7] ..... E05C 3/06
(52) U.S. Cl. ..... 292/216; 292/201; 292/DIG. 23
(58) Field of Search ..... 292/216, 201, 292/DIG. 23; 70/264

(56) References Cited

U.S. PATENT DOCUMENTS 4,762,348 A * 8/1988 Matsumoto ..... 292/201
5,411,302 A * 5/1995 Shimada ..... 292/201
5,474,338 A * 12/1995 Buscher ..... 292/201
5,938,251 A * 8/1999 Watanabe ..... 292/201
5,947,536 A * 9/1999 Mizuki ..... 292/201
2001/0013236 A1 8/2001 Weyerstall et al.

FOREIGN PATENT DOCUMENTS

DE 38 36 771 A1 1/1990
DE 196 14 122 10/1997
DE 197 14 992 A1 9/1998

* cited by examiner

*Primary Examiner*—Gary Estremsky
(74) *Attorney, Agent, or Firm*—Nixon Peabody LLP; David S. Safran

(57) ABSTRACT

A motor vehicle door lock with a drive mechanism and an assigned actuating element for moving a detent pawl, the drive mechanism being coupled to the detent pawl via a coupling mechanism. Good functionality and high fault tolerance are achieved by the coupling mechanism being coupled only when the inside handle and/or the outside handle assigned to the motor vehicle door lock is actuated.

32 Claims, 3 Drawing Sheets

MOTOR VEHICLE DOOR LOCK WITH A CONTROLLED ACTUATING ELEMENT

BACKGROUND OF THE INVENTION

1. Field of the Invention

The present invention is directed to a lock for a motor vehicle door such as a side door lock, a rear door lock, a rear hatch lock, a hood lock or the like.

2. Description of the Prior Art

Published German Patent Application DE 196 14 122 A1 discloses a conventional motor vehicle door lock which has an electric motor for driving the actuating element. The motor vehicle door lock has worm gearing which can be rotated by a drive, an assigned worm wheel which as the actuating element bears a driving journal which can be moved along a peripheral section against spring force. The driving journal can pivot out the detent pawl of the motor vehicle door lock to release an assigned lock latch. Once the detent pawl is pivoted out, the driving journal strikes a stop on the detent pawl which blocks further motion of the driving journal. When the driving journal reaches a trailing position along the peripheral section, the drive is blocked again and thereupon shut off. Only when the detent pawl executes an overstroke motion does the stop clear the path of motion of the driving journal which then continues to move by spring force along the peripheral section into a leading position which does not limit the motion of the detent pawl. The movable support of the driving journal on the worm wheel can be regarded as a coupling between the drive and the actuating element.

In the conventional motor vehicle door lock, it is a disadvantage in that failure of the drive with the detent pawl partially pivoted out can lead to permanent blocking of the detent pawl so that it can no longer block the lock latch in the closed state. Furthermore, it is disadvantageous that the drive for the motor vehicle door lock can be used solely for actuating the detent pawl. In addition to the problem that "dummy" closing must be reliably prevented, in motor vehicle door locks with an electrical opening aid, there is an additional problem that occurs due to a defect in the controller. This defect results in the electric motor drive being triggered when the motor vehicle is in operation, and thus, the motor vehicle door can open while the motor vehicle is being driven.

SUMMARY OF THE INVENTION

An object of the invention is to provide a motor vehicle door lock which precludes unwanted blocking of a lock element, such as a detent pawl, even when the drive fails, and has higher functionality.

These and other objects are achieved by providing a motor vehicle door lock including a coupling which couples only when the inside handle or outside handle assigned to the motor vehicle door lock is actuated, and thus, establishes a dynamic connection between the drive and the lock element. Otherwise, the coupling remains preferably opened. Accordingly, a lock element such as a detent pawl, even with the drive failed, and regardless of the failure position of the drive or an assigned actuating element, can assume a desired position, such as blocking an assigned lock latch. As a result of the aforementioned functionality, a defect in the controller while driving which leads to unwanted starting of the drive does not lead to a malfunction, and thus, to opening of the motor vehicle door during operation of the motor vehicle. Accordingly, a door handle such as an outside handle, will not actuate and coupling and lifting of the detent pawl does not occur.

Moreover, due to the coupling, the use of the drive for other functions is enabled regardless of the motion of the actuating element or the lock element. Accordingly, a greater diversity of functions of the motor vehicle door lock is enabled. In practice, it has been found to be especially feasible to integrate the coupling into the gearing which is connected anyway to the drive and via which the actuating element can be driven. To accomplish this, the gearing is made as planetary gear system with three gear shafts, the third gear shaft of which is blocked when at least one of the inside handle and the outside handle is actuated by the control means.

Other details, features, objectives and advantages of this invention are detailed below using the drawings of one preferred embodiment.

DETAILED DESCRIPTION OF THE PREFERRED EMBODIMENTS

Figure 1:
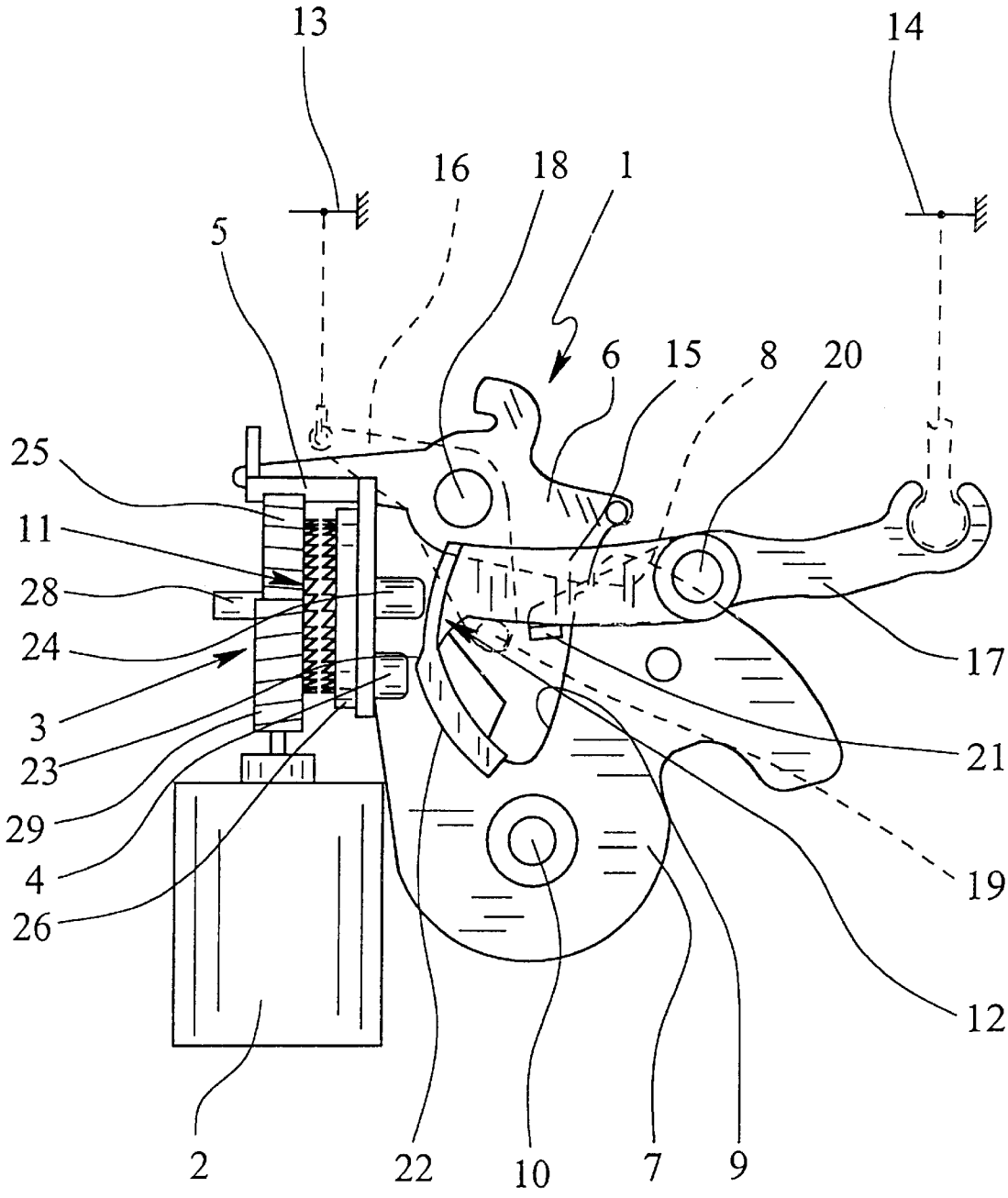
FIG. 1 shows a schematic side view of a first embodiment of a motor vehicle door lock in accordance to the present invention.
Figure 2:
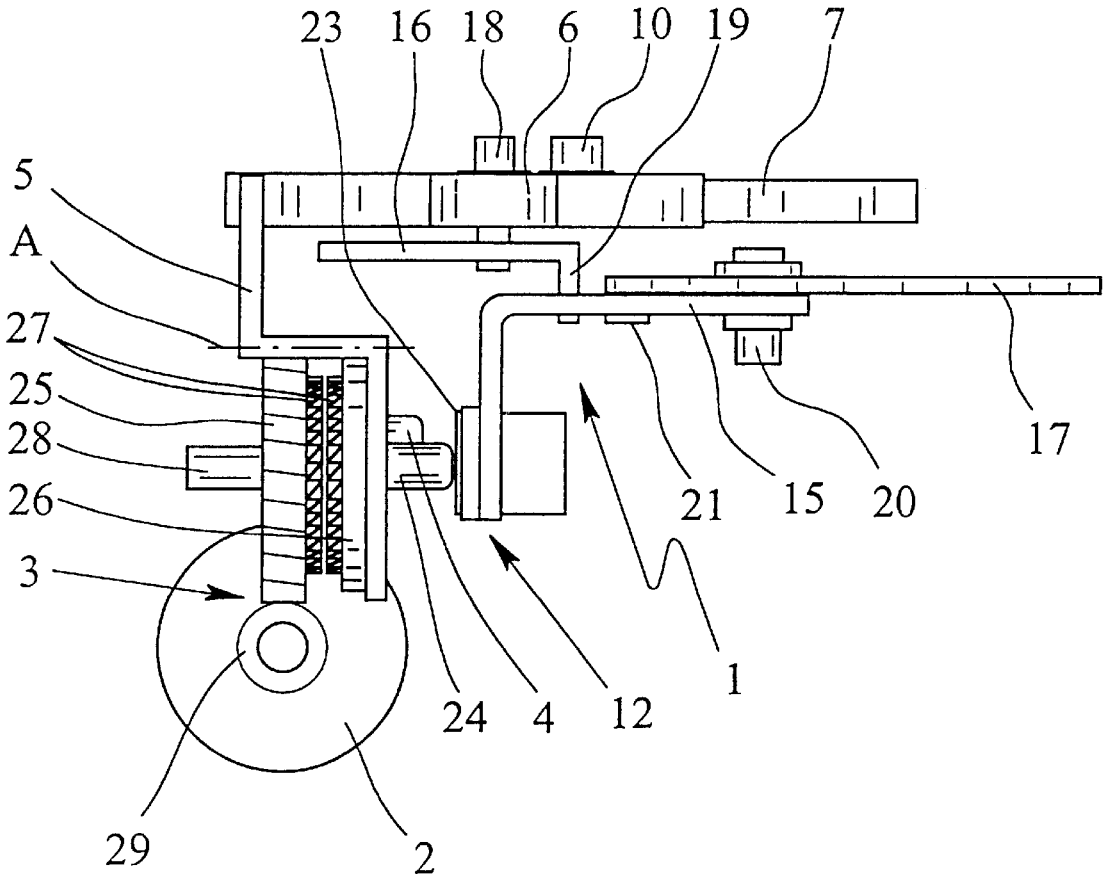
FIG. 2 shows an overhead view of the motor vehicle door lock from FIG. 1.

FIGS. 1 and 2 show in a simplified schematic a motor vehicle door lock 1 in accordance to the present invention including a electric motorized drive 2. The drive 2 is connected to gearing 3 by which the drive 2 drives an actuating element 4 which is made like a journal. Preferably, the actuating element 4 is moved along a peripheral, circular path of motion by the drive 2 to actuate via an actuating lever 5 a lock element such as a detent pawl 6. The motor vehicle door lock I also includes a lock latch 7 which is made as a fork latch or rotary latch and which is assigned to the detent pawl 6. FIGS. 1 and 2 shows the motor vehicle door lock 1 in a closed state, i.e., with the lock latch 7 blocked. FIG. 1 shows that the detent pawl 6 in a latched state latches into a catch 8, such as a main catch or a preliminary catch, of the lock latch 7, and thus, blocks the lock latch 7 against opening. A clamp (not shown) is held by the fork area 9 of the lock latch 7 having a bearing axis and pivot axis 10.

The drive line formed by the drive 2 as far as the lock element, here the detent pawl 6, to be moved or actuated has a coupling 11 which is used for interrupting the drive line. In particular, the coupling 11 is positioned between the drive 2 and the actuating element 4, preferably, between the worm gear 3 and the actuating element 4. However, the coupling 11 may also encompass at least one of the actuating element 4, the lock element and the detent pawl 6, and thus, form a single coupling element. A control means 12 is assigned to the coupling 11 and is provided to control coupling and uncoupling of the coupling 11. FIG. 1 shows that an inside handle 13 assigned to at least one of the motor vehicle door lock 1 and an outside door handle 14 is coupled to the coupling 11 via the control means 12 so that the coupling 11 couples when at least one of the inside handle 13, the outside handle 14 and a switch assigned to the handles 13, 14 is actuated, and thus, establishes a dynamic connection between the drive 2 and the actuating element 4. The coupling 11 or the control means 12 can be electrically coupled to at least one of the inside handle 13 and the outside handle 14. Preferably, the coupling is done mechanically, as in the preferred embodiment detailed below.

The control means 12 acts mechanically on the coupling 11 and has a coupling lever 15 which can cause coupling (closing) of the coupling 11. The coupling lever 15 is actuated by at least one of the inside actuating lever 16 and the outside actuating lever 17 of the motor vehicle door lock 1. FIG. 1 shows the inside actuating lever 16 by a broken line for greater clarity. The inside actuating lever 16 is coupled to the inside handle 13, as shown in FIG. 1 by the broken line, via a rod, a Bowden cable or the like. Accordingly, the outside actuating lever 17 can be coupled to the outside handle 14. The inside actuating lever 16 is made as a two-armed lever and is pivotably mounted about an axis 18 which is also used as a pivot support for the detent pawl 6. The inside actuating lever 16 on one lever end has a transversely overhanging projection 19 which extends over or under the coupling lever 15 for pivoting the latter.

The outside actuating lever 17 is pivotably mounted about an axis 20 which is also used for pivot support of the coupling lever 15. The outside actuating lever 17 is likewise made as a two-armed lever and has a transversely overhanging projection 21 which extends over or under the coupling lever 15 so that when the outside actuating lever 17 is pivoted the coupling lever is pivoted accordingly. When the coupling lever is pivoted out of the pivoting position shown in FIG. 1, the coupling 11 is closed (i.e., coupled) as a result of actuating at least one of the inside handle 13 and the outside handle 14 via the inside actuating lever 16 or the outside actuating lever 17. In the operating state shown in FIG. 1, with the inside handle 13 not actuated and with the outside handle 14 not actuated, the coupling 11 is open, therefore, uncoupled. The coupling lever 15 is made essentially L-shaped and has a contact surface 22 which faces the coupling 11, with a contact bevel 23 which interacts with the coupling element 24 such that the coupling 11 is closed or opened depending on the pivot position of the coupling lever 15. The coupling element 24 is made like a journal, and the contact surface 22 or bevel 23 acts on the end face of the coupling element 24 such that the coupling 24 is moved axially depending upon the pivoting position of the coupling lever 15. This axial motion or displacement controls the coupling and uncoupling of the coupling 11.

The coupling 11 has two gear wheels 25, 26 which each have axial teeth 27 and are located coaxially on a common axis 28 so that the gear wheels 25, 26 engage one another via the teeth 27 when axially pushed together. The coupling 11 in this state is closed or coupled. The gear wheels 25, 26 are not engaged when axially pushed away from one another, as in the operating state shown in FIGS. 1 and 2. The coupling is thus, opened or uncoupled so that no drive connection exists between the drive 2 and the actuating element 4. The teeth 27 of the gear wheels 25, 26 are preferably formed very fine and matched to one another such that coupling in any relative position of the gear wheels 25, 26 is made possible. Engagement occurs only in the drive direction or drive rotation direction, therefore, the coupling 11 transfers forces at least essentially only in one drive direction to the actuating element 4.

In an exemplary embodiment, a function element 24 is located centrally on the gear wheel 26 and extends along the axis 28, and projects toward the coupling lever 15 or its contact surface 22. The gear wheel 26 bears the actuating element 4 which is located eccentrically and solidly on the driven-side gear wheel 26. A spring (not shown), acts between the gear wheels 25, 26 in the axial direction and presses the gear wheels 25, 26 apart so that the coupling 11 is normally opened. Only when by pivoting the coupling lever 15 do the teeth 27 engage, with the coupling 11 closed its contact bevel 23 and contact surface 22 via the function element 24 shift the gear wheel 26 axially to the gear wheel 25 as the spring force is overcome. The gear wheel 25 in this embodiment forms an element of the gearing 3. The gear wheel 25 is made as a worm wheel which can be turned by the drive 2 via the engaging worm 29 of the gearing 3.

Of course other designs are also possible for the electric motor drive 2, the gearing 3 and the coupling 11. In particular, it is not necessary for the coupling 11 to be made for transmission of rotary motions, for example, translational movements can be transmitted or coupled. Instead of an electric motor, the drive 2 can have either a magnetic actuating drive, a pneumatic actuating drive, a hydraulic actuating drive, a linear motor, or the like. Depending upon the execution and requirements the gearing 3 can be matched or omitted.

When the inside handle 13 or the outside handle 14 is actuated, the coupling 11 is closed via the control means 12 and the pivoting coupling lever 15. At the same time, the drive 2 is turned on by a switch, a sensor or the like (not shown) and is assigned to the inside handle 13, the outside handle 14, or by a controller (not shown) which evaluates the corresponding signals. Accordingly, the drive 2 works in one direction of rotation which as a result of the closed coupling 11 leads to actuation or movement of the actuating element 4. The actuating element 4 executes circular motion and pivots the assigned actuating lever 5 such that the lever 5 lifts the detent pawl 6 and unlatches the pawl 6 from the catch 8 and thus releases the lock latch 7. The motor vehicle door lock 1 is then opened. After the detent pawl 6 is lifted the drive 2 can be turned off. This can be done for example by means of a sensor, a switch, or the like which is not shown, or by the actuating element 4 striking a stop which is not shown. But the drive 2 can also remain off, so that the actuating element 4 continues to move along its path of motion in order for the actuating lever 5 to pivot back and thus the detent pawl 6 to be released.

The actuating lever 5 is preferably made with two arms and is supported to be able to pivot around an axis A. The detent pawl 6 and/or the actuating lever 5 are spring-loaded such that with the coupling 11 opened, the actuating element 4 is moved or pressed away, or the actuating lever 5 and/or the detent pawl 6 can be reset by spring force. Accordingly, when the drive 2 fails or the gearing 3 is blocked, the detent pawl 6 engages, and in the closed state of the motor vehicle door lock 1, blocks the lock latch 7. The coupling 11 opens, and thus, the detent pawl 6 or another lock element which is actuated by the drive 2 is released when the handles 13, 14 are no longer actuated and the coupling lever 15, especially by the corresponding pretensioning by means of a spring (not shown), assumes its neutral position which is shown in FIG. 1, the position which does not close the coupling.

In order to enable opening of the motor vehicle door lock 1 even when the drive 2 has failed, the gearing 3 is blocked to provide or the like an emergency opening function. This can be done by the inside handle 13, the outside handle 14, a lock cylinder (not shown) being coupled to the detent pawl 6, preferably, over sufficient play, by the actuation of the inside handle 13, the outside handle 14 or a lock cylinder (not shown), which actuation goes above and beyond the normal opening position, leading to lifting of the detent pawl 6, and thus, to release of the lock latch 7. The drive 2 can be used, if necessary, for other functions of the motor vehicle door lock 1, especially actuating functions. This is especially possible by the coupling 11 being only closed or coupled when the handles 13, 14 are actuated. Otherwise, the coupling 11 is open or uncoupled so that without actuating or moving the actuating element 4 or the assigned lock element, the drive 2 can be turned on and can execute other functions via the gearing 3 or other gearing. The corresponding applies when the drive 2 is operating in the opposite drive direction, the coupling in this drive direction not acting in the coupled or closed state or not exerting noteworthy forces on the actuating element 4 or the assigned lock element, here the detent pawl 6. A very compact structure of the motor vehicle door lock 1 is achieved by axes 10, 18, and 20 running in parallel, conversely the axis 28 of the coupling 11 and the axis of rotation of the drive 2 being perpendicular thereto and preferably also to one another.

Figure 3:
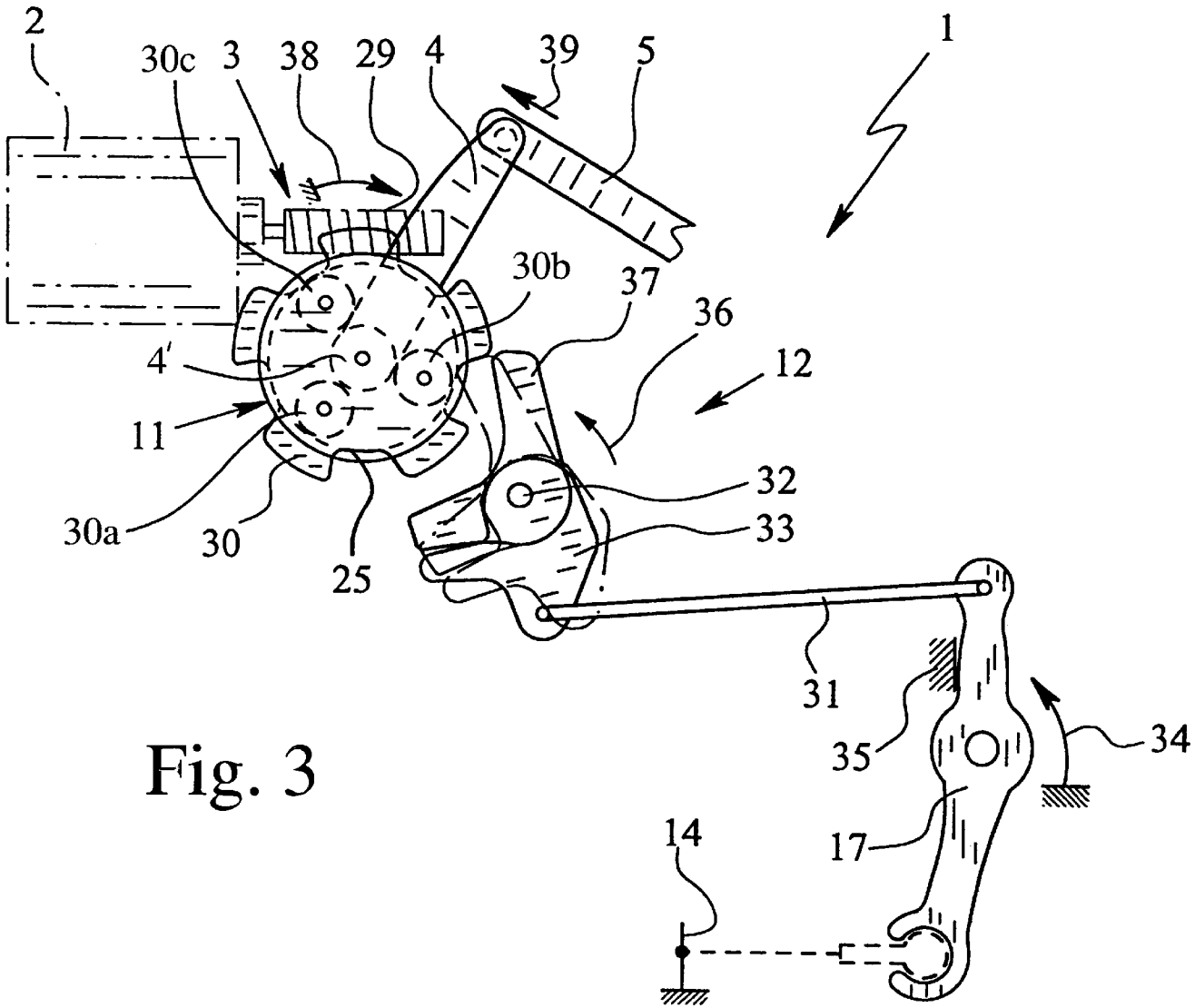
FIG. 3 shows a schematic side view of another embodiment of a motor vehicle door lock in accordance to the present invention.

FIG. 3 shows another preferred embodiment of a motor vehicle door lock 1 whereby the gears 3 is connected to the drive 2 and the actuating element 4 is driven by the drive 2 via the gears 3. However, in this embodiment, the coupling 11 is integrated into the gears 3 since the gears 3 are made as a planetary gear train. A planetary gear train is a gear system with three gear shafts which are kinematically of equal rank. If one of the gear shafts is fixed, there results forced geared coupling of the other two gear shafts. If one gear shaft is driven and none of the other two gear shafts is fixed, there results a state which is determined by the driven torques which act as brakes on the other two gear shafts. The properties of the planetary gear train are exploited by the coupling 11 being coupled by the blocking of one gear shaft of the planetary gear train. Therefore, the gearing 3 and the coupling 11 are combined in a highly compact manner in one assembly. At the same time, high multiplications can be achieved with a planetary gear train, which is advantageous for small-power electric motors with high rpm, the types which are commonly used in motor vehicle doorlocks.

In operation, one gear shaft 25 of the planetary gear train is connected to the drive 2 and another gear shaft 4' is connected to the actuating element 4. The third gear shaft shown as 30*a*, 30*b*, 30*c*, first runs freely, therefore, without an element which is driven by it. However, the control means 12 is assigned to the third gear shaft. The coupling 11 is coupled by the control means 12 blocking the third gear shaft when the outside handle 14 here is actuated. The electric motor drive 2 can therefore start, wanted or unwanted, without the actuating element 4 initially being moved. The starting of the drive 2 initially moves only the first gear shaft 25, via worm 29, and its motion is followed by the third gear shaft 30*a*, 30*b*, 30*c* which can run freely in this state. The driven torque on the second gear shaft 4' which is connected to the actuating element 4 is specifically much higher than the driven torque of the freely running gear shaft. Consequently, the actuating element 4 remains stationary, the lock element, especially the detent pawl 6, is not moved. When the coupling 11 engages, and, due to the fact that the control means 12 as moved by the outside handle 14 now blocks the third gear shaft, the drive motion of the electric motor drive 2 is necessarily transmitted to the actuating element 4.

The embodiment shown in FIG. 3 shows one embodiment in which the third gear shaft 30*a*, 30*b*, 30*c* has a gear wheel 30 and can be adjusted by blocking for coupling of the control means 12 to the gear wheel 30. In particular, the outside actuating lever 17 is coupled via an actuating rod 31 to a driver 33 which is pivotally mounted on the pivoting axis 32. The outside actuating lever 17 is pretensioned in the direction shown by the arrow by means of a pretensioning spring 34, against a stop 35. On the driver 33 a catch 37 which is pretensioned in the illustrated direction by a spring 36, is supported on the same pivoting axis 32 which ultimately then engages or is caused to engage the gear wheel 30. The actuating element 4 which is connected to the second gear shaft 4', also acts on an actuating lever 5 which lifts the detent pawl 6.

As shown in FIG. 3, the pretensioning spring 34 pretensions the control means 12 against the adjustment direction. For this reason, without the actuation of the outside handle 14, the control means is not engaged with the gear wheel 30 which is connected to the third gear shaft. Only by the actuation of the outside handle 14 is the catch 37 caused to engage the gear wheel 30 so that the gear wheel 30 is blocked. In this way, drive coupling of the drive 2 to the actuating element 4 is accomplished. The catch 37 acts with respect to the gear wheel 30 as a supporting detent pawl. The dot-dash line shows the engaged position of the catch 37. It is recognized that the line of force action is directed from the tooth of the gear wheel 30 exactly to the pivot axis 32 of the catch 37 and the driver 33 so that the supporting forces are accommodated at that point. The contour of the catch 37 and of the teeth of the gear wheel 30 is chosen such that pivoting-out of the catch 37 when the outside handle 14 is released under the spring force of the pretensioning spring 34 is ensured.

In FIG. 3, the spring 36 which pretensions the catch 37 counterclockwise against the driver 33 ensures that the catch 37 under spring force with the outside handle 14 pulled also engages when it comes into contact first with the greater outside periphery of one tooth of the gear wheel 30. As the gear wheel 30 continues to turn then the catch 37 springs in and performs its support function. When the outside handle 14 is actuated, first the coupling 11 is closed via the control means 12 in that the control means 12 or its catch 37 engages the gear wheel 30 by blocking. At the same time, or immediately thereafter, the drive 2 is turned on by a switch (not shown) on the outside handle 14. Accordingly, the drive 2 works via the gearing 3 on the actuating element 4, because the third gear shaft is already blocked by the control means 12. For example, the actuating element 4 is then moved or pivoted against the force of the suggested (reset) spring 38 in the direction 39 of the arrow. In this way, the actuating lever 5 is actuated and the detent pawl 6 is lifted. The pretensioning spring 34 on the outside actuating lever 17 or the outside handle 14 should be so strong in this embodiment such that it can overcome the frictional forces to pivot the control means 12 away from the gear wheel 30. This ensures that the gearing 3 is always released when the outside handle 14 is not actuated.

It may also be provided that the electric drive 2 is already turned on when the outside handle 14 is actuated before the control means 12 has blocked the gear wheel 30. Accordingly, the catch 37 with the gear wheel 30 already turning would have to be able to engage. This requires a corresponding configuration of the mechanical structure, which however is feasible. This concept would have the advantage that the starting delay of the electric drive 2 could be taken into account for purposes of actuating the motor vehicle door lock 1 as fast as possible. The electric motor drive 2 can stop after the lifting of the detent pawl 6 with the overstroke which is accordingly required structurally, it, therefore, need not turn back. This is due to the fact that the control means 12 is pivoted by the force of the pretensioning spring 34 away from the gear wheel 30 as soon as the outside handle 14 is released. Then, the third gear shaft is again free and the detent pawl 6 can be reset under the force of its own pretensioning spring back into the engagement direction. The (reset) spring 38 is used for additional support of the reset motion of the actuating lever 5 or of the actuating element 4 which can thus follow the motion of the detent pawl 6. If the electric motor drive 2 is stopped by its being blocked, the voltages which are formed in the system lead to the fact that the catch 37 cannot be pivoted out from the gear wheel 30 by means of the pretensioning spring 34. When these difficulties arise, the electric motor drive 2 can be stopped by a switch. Then the paths can be dimensioned such that the indicated pretensioning does not occur or is so small that the pretensioning springs 34 can be easily pivoted free under a force.

The illustrated embodiment shows the planetary gear train as an eccentric gear system. Of course, the planetary gear train can also be made as an epicyclic gear, the classical example of a planetary gear train. All types of planetary gear trains can be used in principle here when they meet the boundary conditions for installation at this point.

What is claimed is:

1. A motor vehicle door lock for an inside and an outside handle of a motor vehicle, said motor vehicle lock comprising:

a drive mechanism;

a lock element including a detent pawl;

an actuating element for moving said detent pawl, said actuating element being driven by said drive mechanism;

coupling mechanism for coupling said drive mechanism to said actuating element; and a control means for activating said coupling mechanism, wherein the coupling mechanism is open with the actuating element decoupled from the drive mechanism as long as the coupling mechanism is not activated, and wherein the coupling mechanism is activated with the actuating element coupled to the drive when at least one of the inside handle and the outside handle is actuated.

2. The motor vehicle door lock as claimed in claim 1, wherein said control means mechanically interacts with said coupling mechanism.

3. The motor vehicle door lock as claimed in claim 1, further comprising a coupling for connecting said control means to the inside handle and the outside handle.

4. The motor vehicle door lock as claimed in claim 2, further comprising a coupling for connecting said control means to the inside handle and the outside handle.

5. The motor vehicle door lock as claimed in claim 4, wherein said control means has a coupling lever for mechanical actuating said coupling mechanism in a closed position.

6. The motor vehicle door lock as claimed in claim 5, further comprising an actuating lever for mechanically connecting said coupling lever to the inside handle and the outside handle via an actuating lever.

7. The motor vehicle door lock as claimed in claim 6, wherein said coupling lever and said actuating lever are pivotably supported about the same axis.

8. The motor vehicle door lock as claimed in claim 1, further comprising an electrical coupling for connecting said control means to the inside handle and the outside handle.

9. The motor vehicle door lock as claimed in claim 7, wherein said coupling mechanism is formed of parts which are engageable by force-fit.

10. The motor vehicle door lock as claimed in claim 8, wherein said coupling mechanism is formed of parts which are engageable by form-fit.

11. The motor vehicle door lock as claimed in claim 9, wherein said coupling mechanism acts to couple said drive mechanism to said actuating element in one drive direction.

12. The motor vehicle door lock as claimed claim 11, wherein said coupling mechanism is constructed to transmit rotary motion.

13. The motor vehicle door lock as claimed in claim 12, wherein said coupling mechanism has two axially toothed gear wheels engageble with one another by axial displacement.

14. The motor vehicle door lock as claimed in claim 13, wherein said two axially toothed gear wheels are engageble with one another via said coupling lever.

15. The motor vehicle door lock as claimed in claim 13, wherein said two axially toothed gear wheels are engageable with one another via said coupling lever when said coupling mechanism is in the closed position.

16. The motor vehicle door lock as claimed in claim 15, wherein said two axially toothed gear wheels are engageable by form-fit in one drive direction.

17. The motor vehicle door lock as claimed in claim 16, further comprising a spring acting upon said coupling mechanism acts in a direction away from said closed position.

18. The motor vehicle door lock as claimed in claim 15, wherein said coupling mechanism includes a spring which pretensions said two axially toothed gear wheels to disengage from each other.

19. The motor vehicle door lock as claimed in claim 18, wherein said coupling mechanism includes a gear wheel which carries said actuating element.

20. The motor vehicle door lock as claimed in claim 19, wherein said actuating element comprises a journal and is mounted eccentrically on said gear wheel.

21. The motor vehicle door lock as claimed in claim 20, further comprising an actuating lever, said actuating lever being pivotably engageable by said actuating element to actuate said the lock element by unlatching said detent pawl from a lock latch.

22. The motor vehicle door lock as claimed in claim 21, wherein at least one of said actuating lever and said detent pawl is pretensioned by spring force into a position in which said coupling mechanism is placed in an opened position.

23. The motor vehicle door lock as claimed in claim 1, further comprising a gear system mechanically connected to said drive mechanism and said actuating element for enabling said actuating element to be driven by said drive mechanism via said gear system, said gear system being a planetary gear train.

24. The motor vehicle door lock as claimed in claim 23, wherein said coupling mechanism is integrated into said planetary gear train.

25. The motor vehicle door lock as claimed in claim 24, wherein said planetary gear train includes a first gear shaft connected to said drive mechanism, a second gear shaft connected to said actuating element, and a third gear shaft running freely.

26. The motor vehicle door lock as claimed in claim 25, wherein said control means is assigned to said third gear shaft and wherein said coupling mechanism is placed in the closed position when said control means blocks said third drive shaft upon actuation of the inside handle or the outside handle.

27. The motor vehicle door lock as claimed in claim 26, wherein said third gear shaft has a gear wheel which is engageable by said control means for displacement of said gear wheel in a displacement direction.

28. The motor vehicle door lock as claimed in claim 27, wherein said planetary gear train is an eccentric gearing system.

29. The motor vehicle door lock as claimed in claim 27, wherein said planetary gear train is an epicyclic gearing system.

30. The motor vehicle door lock as claimed in claim 29, wherein said control means is spring-pretensioned in direction counter to said displacement direction.

31. The motor vehicle door lock as claimed claim 1, further comprising a switch and wherein said drive mechanism is an electric motor drive, said switch being adapted to turn off said electric motor drive when said detent pawl is lifted.

32. The motor vehicle door lock as claimed in claim 31, wherein said drive mechanism is adapted to be actuated before said coupling mechanism is placed in a closed position when either of the inside handle and the outside handle is actuated.

* * * * *